US011796932B2

(12) United States Patent
Hiura et al.

(10) Patent No.: US 11,796,932 B2
(45) Date of Patent: Oct. 24, 2023

(54) IMAGE FORMING APPARATUS AND IMAGE FORMING SYSTEM

(71) Applicant: CANON KABUSHIKI KAISHA, Tokyo (JP)

(72) Inventors: Hiroshi Hiura, Chiba (JP); Shigeo Doi, Ibaraki (JP); Osamu Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/720,155

(22) Filed: Apr. 13, 2022

(65) Prior Publication Data

US 2022/0350270 A1 Nov. 3, 2022

(30) Foreign Application Priority Data

Apr. 30, 2021 (JP) ..... 2021-077682

(51) Int. Cl.
*G03G 15/01* (2006.01)
*G03G 15/08* (2006.01)

(52) U.S. Cl.
CPC ..... *G03G 15/0142* (2013.01); *G03G 15/0887* (2013.01); *G03G 2221/169* (2013.01)

(58) Field of Classification Search
CPC ..... G03G 21/1633; G03G 15/6529; G03G 21/1638; G03G 21/1647; G03G 21/185
See application file for complete search history.

(56) References Cited

U.S. PATENT DOCUMENTS

| | | | | |
|---|---|---|---|---|
| 2005/0134668 | A1* | 6/2005 | Takahashi | G03G 15/6529 347/156 |
| 2016/0098007 | A1 | 4/2016 | Doi et al. | 49/394 |
| 2016/0102488 | A1 | 4/2016 | Doi et al. | 49/350 |
| 2017/0219990 | A1* | 8/2017 | Ishida | G03G 21/1633 |
| 2017/0255130 | A1* | 9/2017 | Ui | G03G 21/1695 |
| 2017/0370396 | A1 | 12/2017 | Kitajima et al. | F16B 37/122 |
| 2020/0217369 | A1 | 7/2020 | Hiura et al. | B65H 2404/17 |
| 2020/0257237 | A1* | 8/2020 | Hyodo | G03G 21/1633 |

FOREIGN PATENT DOCUMENTS

JP H06-242677 9/1994

* cited by examiner

*Primary Examiner* — Jessica L Eley
(74) *Attorney, Agent, or Firm* — Venable LLP

(57) ABSTRACT

An image forming apparatus including: a first door rotatable about a first rotation axis extending in a width direction within a first rotation range between a first open position and a first closed position; a second door provided below the first door and rotatable about a second rotation axis extending in a direction orthogonal to the first rotation axis within a second rotation range between a second open position and a second closed position, a part of the first rotation range making inroads into the second rotation range; and a retracting portion configured to rotate the first door to a retracted position to allow a rotation of the second door in conjunction with the second door being rotated to the second closed position from a state in which the first door is in the first open position and the second door is in the second open position.

12 Claims, 14 Drawing Sheets

IMAGE FORMING APPARATUS AND IMAGE FORMING SYSTEM

BACKGROUND OF THE INVENTION

Field of the Invention

The present invention relates to an image forming apparatus and an image forming system configured to form an image on a recording medium.

Description of the Related Art

Typically, an electrophotographic image forming apparatus is required to be supplied with a consumable such as toner, which is used along with image formation. Further, maintenance work on components associated with an electrophotographic process is required to be performed as needed. A main body of the image forming apparatus has an openable and closable door to allow access to an inside of the main body of the image forming apparatus so that a consumable is supplied or maintenance work is performed.

The electrophotographic image forming apparatus employs an electrophotographic image forming process to form an image on a recording medium. Examples of the image forming apparatus include a copying machine (such as a digital copying machine), a printer (such as a color laser beam printer or a color LED printer), a multi-functional peripheral (MFP), and a facsimile machine. The image forming apparatus is not limited to an image forming apparatus configured to form a color image, but may also be an image forming apparatus configured to form a monochrome image.

In Japanese Patent Application Laid-Open No. H06-242677, there is disclosed an image forming apparatus including a first door member and a second door member. The first door member is openably and closably supported so as to cover an area to be subjected to maintenance. The second door member is supported so as to cover a replacement component mounting portion and to be openable and closable independently of the opening and closing of the first door member. The second door member has a guide portion on its inner surface. The guide portion is formed for insertion of a replacement component into the replacement component mounting portion. When the second door member is opened and the replacement component is inserted along the guide portion, the replacement component is smoothly mounted in the replacement component mounting portion. The first door member, which is opened and closed for maintenance, and the second door member, which is opened and closed for replacement of a replacement component, are arranged so that the first door member does not interfere with the second door member when the first door member is opened and closed.

When an image forming apparatus has a plurality of doors and one of the doors is opened or closed, however, the one door may interfere with another one of the doors depending on the arrangement of the plurality of doors. For example, one of the doors is opened with another one of the doors open to perform work. When the another door is closed prior to closing of the one door after the end of the work, the another door may interfere with the one door. In this case, collision of the another door against the one door may damage any one of the doors or a holding member for holding any one of the doors.

SUMMARY OF THE INVENTION

In view of the circumstances described above, the present invention provides an image forming apparatus that causes a first door to move to a retracted position in conjunction with a closing operation of a second door so as to reduce damage of the first door and the second door.

According to an embodiment of the present invention, there is provided an image forming apparatus configured to form an image on a recording medium, the image forming apparatus comprising:

- a main body provided with a first opening portion and a second opening portion;
- a first door rotatable within a first rotation range between a first open position at which the first door opens the first opening portion and a first closed position at which the first door covers the first opening portion, the first door being rotatable within the first rotation range about a first rotation axis extending in a width direction of the image forming apparatus;
- a second door provided below the first door in a vertical direction and rotatable within a second rotation range between a second open position at which the second door opens the second opening portion and a second closed position at which the second door covers the second opening portion, a part of the first rotation range making inroads into the second rotation range, the second door being rotatable within the second rotation range about a second rotation axis extending in a direction orthogonal to the first rotation axis; and
- a retracting portion configured to cause the first door to rotate to a retracted position, at which the first door allows a rotation of the second door, in conjunction with the second door being rotated to the second closed position from a state in which the first door is located at the first open position and the second door is located at the second open position.

Further features of the present invention will become apparent from the following description of exemplary embodiments with reference to the attached drawings.

DESCRIPTION OF THE EMBODIMENTS

Figure 1:
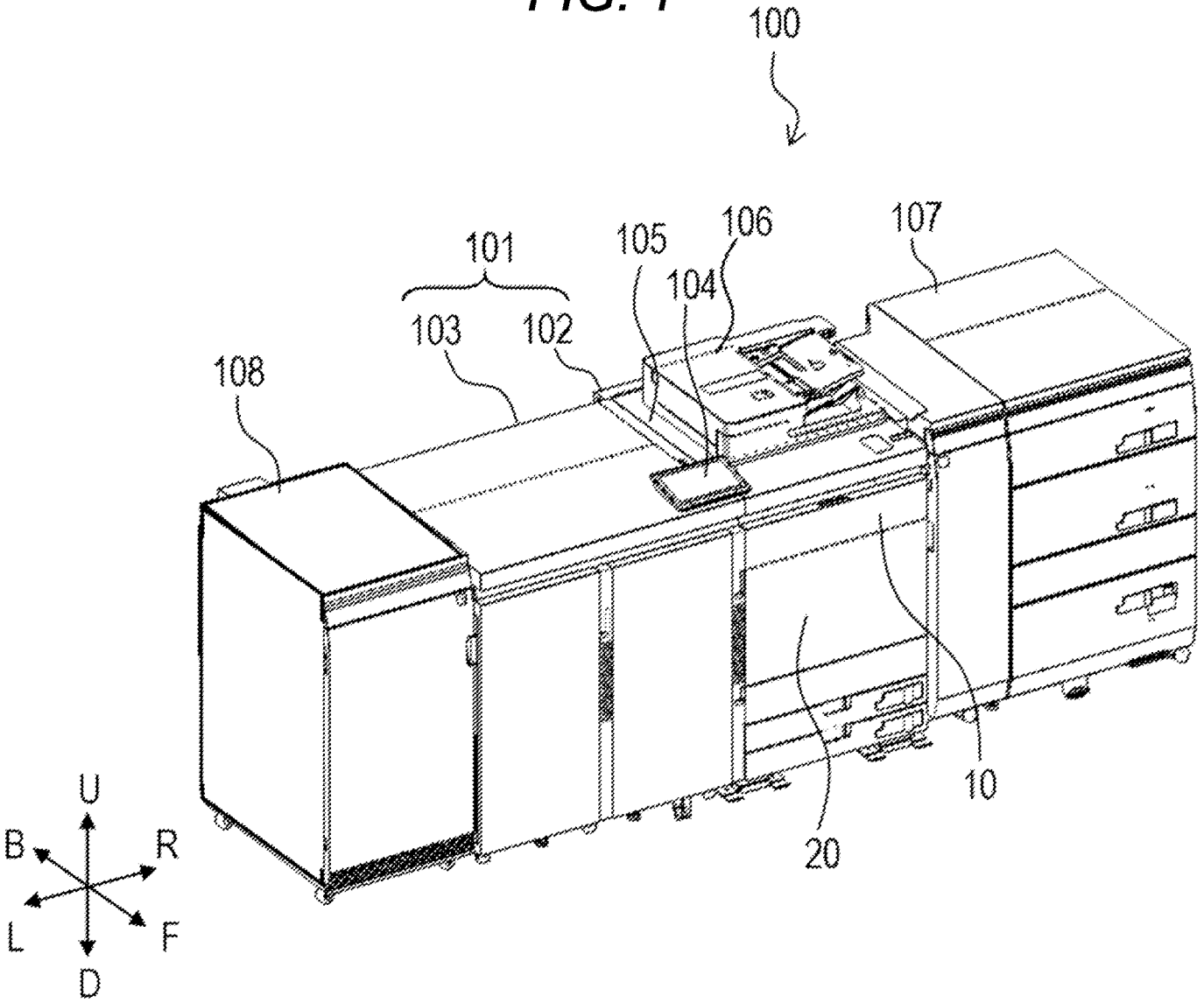
FIG. 1 is a perspective view of an image forming system.

Now, an embodiment of the present invention is described with reference to FIG. 1 to FIG. 11C. In the embodiment, as illustrated in FIG. 1, a direction from an image forming apparatus 101 toward its front side is referred to as "forward direction F", a direction toward its back side (rear side) is referred to as "backward direction B", a direction toward its left side is referred to as "leftward direction L", a direction toward its right side is referred to as "rightward direction R", a direction toward its upper side is referred to as "upward direction U", and a direction toward its lower side is referred to as "downward direction D". However, for example, dimensions, materials, shapes, and relative positions of components described below in the embodiment should be suitably changed based on a configuration of an apparatus to which the present invention is applied or various conditions. Thus, the scope of the present invention is not intended to be limited to those described in the embodiment.

(Image Forming System)

Figure 2:
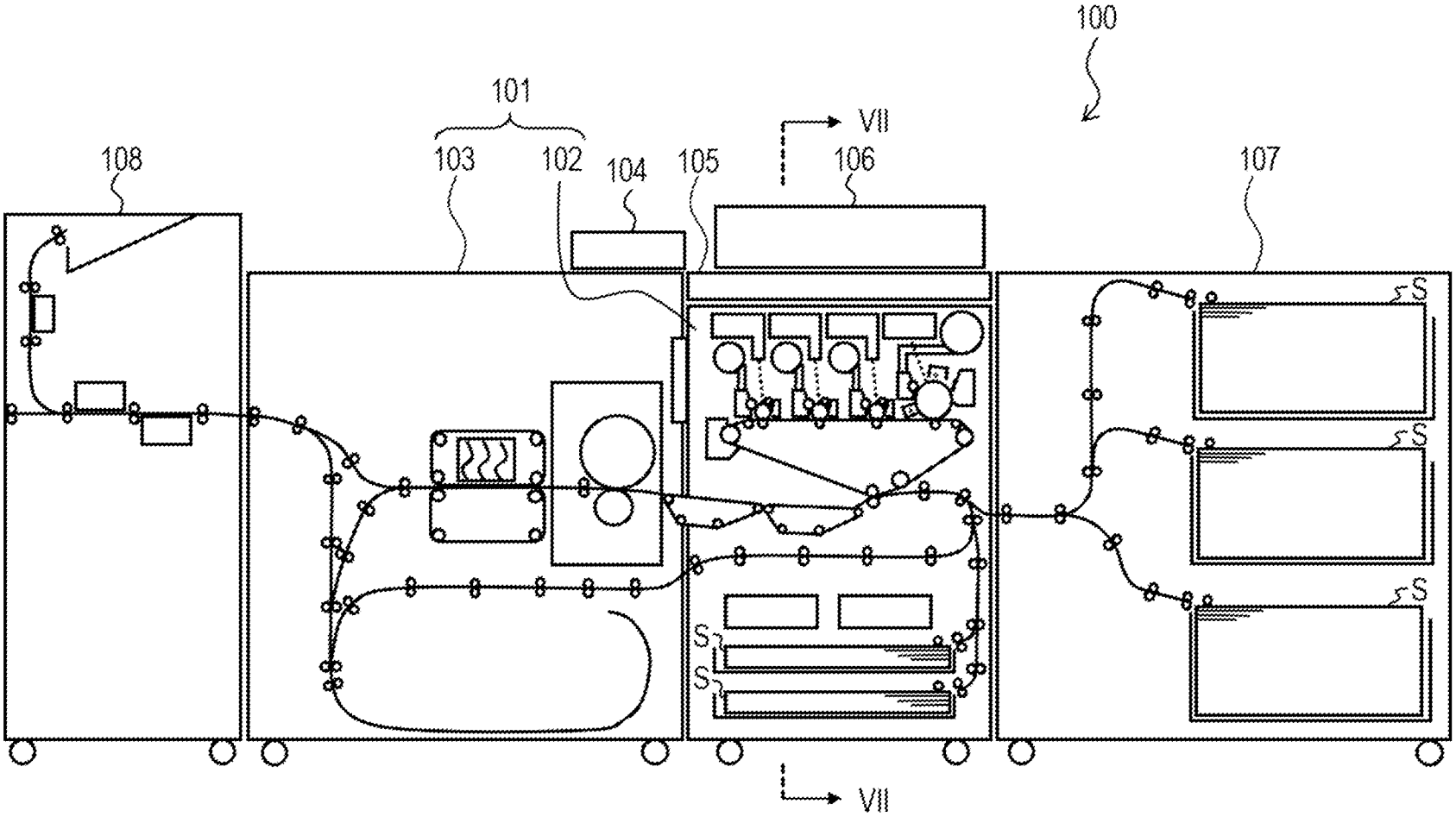
FIG. 2 is a sectional view of the image forming system.

FIG. 1 is a perspective view of an image forming system 100. FIG. 2 is a sectional view of the image forming system 100. The image forming system 100 includes the image forming apparatus 101, a high-capacity feeder 107, and a sensing device 108. The image forming apparatus 101 includes an image forming portion 102 and a fixing conveyance portion (fixing portion) 103. The image forming portion 102 forms a toner image on a recording medium (hereinafter referred to as "sheet") S fed from the high-capacity feeder (feeder) 107. The fixing conveyance portion 103 fixes the toner image formed by the image forming portion 102 onto the sheet S. The image forming portion 102 and the fixing conveyance portion 103 are each constituted of independent housings. With this configuration, the image forming apparatus 101 having a large size can be packed and transported after being separated into the housings. Such a configuration also improves workability in the distribution of the image forming apparatus 101 having a large size, which involves shipping and installation.

An operation portion 104 is provided on top of the fixing conveyance portion 103. The operation portion 104 is used by an operator to operate the image forming apparatus 101. A document reader 105 and an automatic document feeder 106 are provided on top of the image forming portion 102. The automatic document feeder 106 feeds documents from a bundle of documents stacked thereon one by one to the document reader 105. The document reader 105 reads an image of the document fed by the automatic document feeder 106 or an image of a document placed on a platen glass plate (not shown). Optionally, the document reader 105 and the automatic document feeder 106 are selectively connected to the image forming portion 102.

The high-capacity feeder 107 is arranged on an upstream side of the image forming portion 102 in a sheet conveying direction. The high-capacity feeder 107 includes a plurality of sheet storage portions. In place of the high-capacity feeder 107, a manual feeder (not shown) or a long-sheet feeder (not shown) capable of containing long sheets may be selectively connected to the image forming portion 102. Further, another high-capacity feeder (not shown), another manual feeder (not shown), or another long-sheet feeder may be arranged on an upstream side of the high-capacity feeder 107 and be selectively connected thereto so as to achieve double-feeder connection.

The sensing device 108 is arranged on a downstream side of the fixing conveyance portion 103 in the sheet conveying direction. The image forming system 100 is not always required to include the sensing device 108. The sensing device 108 is selectively connected to the fixing conveyance portion 103. The sensing device 108 reads an image formed on one or each of surfaces of the sheet S, and detects an image density deviation and an image position misregistration. The sensing device 108 performs feedback correction on an image signal to be transmitted to the image forming portion 102 based on the detected image density deviation and image position misregistration. One of or a combination of a plurality of post-processing apparatus (not shown) such as an inserter, a puncher, a case binding machine, a high-capacity stacker, a folding machine, a finisher, and a trimmer is arranged on a downstream side of the fixing conveyance portion 103 or the sensing device 108, and is selectively connected to the fixing conveyance portion 103 or the sensing device 108.

As described above, when a variety of optional apparatus are selectively connected to the image forming apparatus 101 according to the embodiment, resultants obtained by performing a variety of post-processing processes on a variety of sheets can be output inline. Thus, the image forming system 100 with high productivity, high image quality, high stability, and high functionality is achieved.

(Image Forming Portion)

Figure 3A:
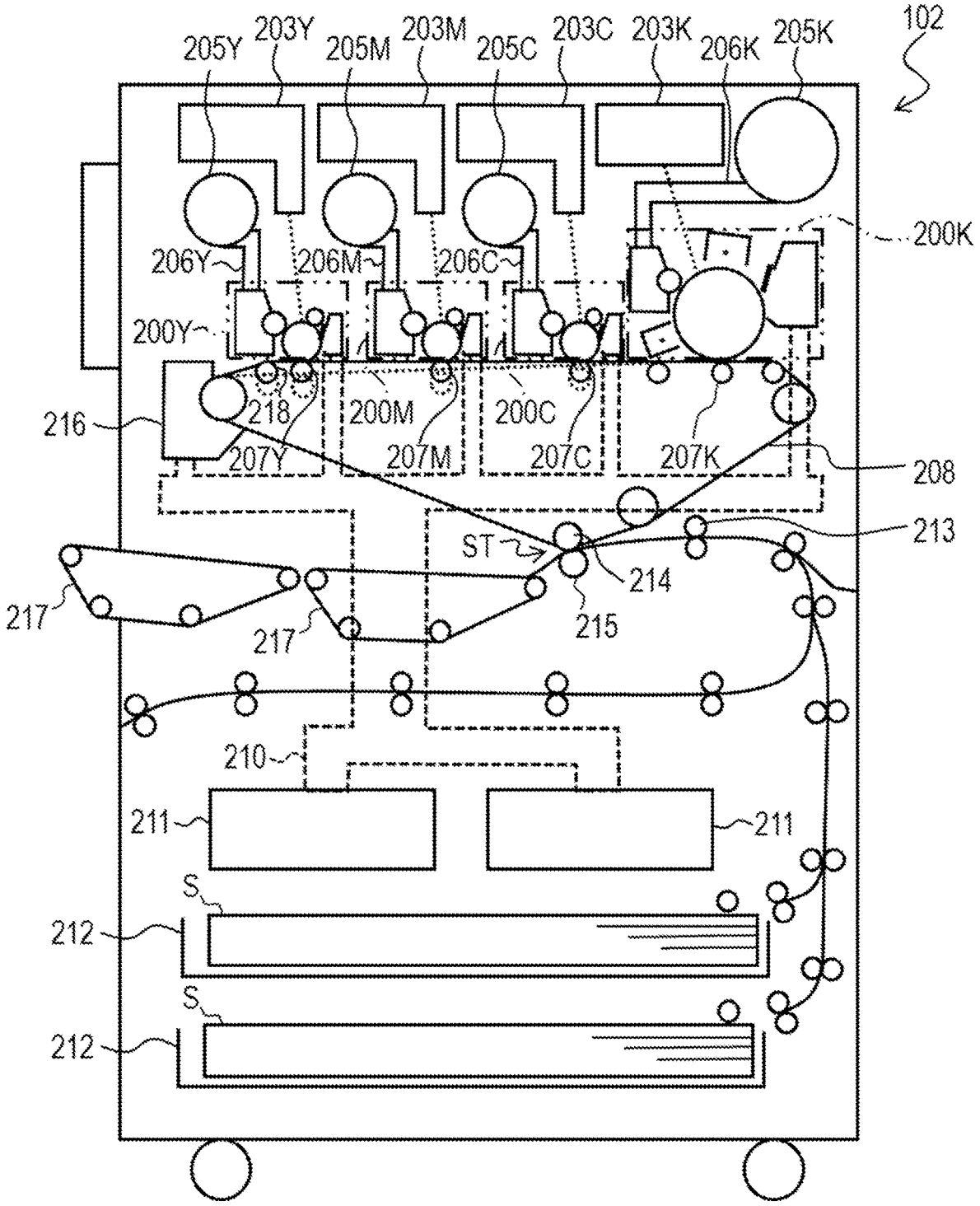
FIG. 3A is a sectional view of an image forming portion.
Figure 3B:
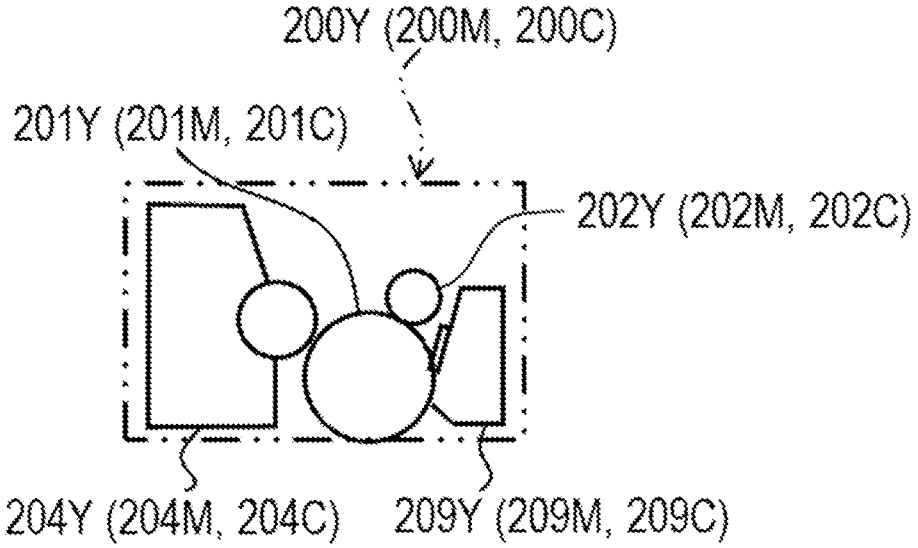
FIG. 3B is a view of a yellow image forming station.

The image forming portion 102 of the image forming apparatus 101 according to the embodiment is described with reference to FIG. 3A, FIG. 3B, and FIG. 3C. FIG. 3A is a sectional view of the image forming portion 102. The image forming portion 102 includes a yellow image forming station 200Y, a magenta image forming station 200M, a cyan image forming station 200C, and a black image forming station 200K. The image forming portion 102 includes laser scanners 203Y, 203M, 203C, and 203K, toner bottles (toner containers) 205Y, 205M, 205C, and 205K, and toner supply paths 206Y, 206M, 206C, and 206K. Suffixes Y, M, C, and K to the reference symbols represent yellow, magenta, cyan, and black, respectively. In the following description, the suffixes Y, M, C, and K may be omitted unless otherwise needed. Further, the image forming portion 102 includes primary transfer rollers 207Y, 207M, 207C, and 207K, an intermediate transfer belt 208, a toner collecting path 210, collected toner containers 211, and sheet storage portions 212. Further, the image forming portion 102 includes registration rollers 213, a secondary transfer inner roller 214, a secondary transfer outer roller 215, an intermediate transfer belt cleaner 216, pre-fixing conveyance belts 217, and an auxiliary primary transfer roller 218. A nip portion between the second transfer inner roller 214 and the secondary transfer outer roller 215 defines a secondary transfer portion ST.

The yellow image forming station 200Y forms a yellow (Y) toner image. The magenta image forming station 200M forms a magenta (M) toner image. The cyan image forming station 200C forms a cyan (C) toner image. The yellow image forming station 200Y, the magenta image forming station 200M, and the cyan image forming station 200C have the same structure. FIG. 3B is a view of the yellow image forming station 200Y. In FIG. 3B, the reference symbols for denoting the structures of the magenta image forming station 200M and the cyan image forming station 200C are parenthesized. The yellow image forming station 200Y (200M, 200C) includes a photosensitive drum 201Y (201M, 201C). A primary charger 202Y (202M, 202C), a developing device 204Y (204M, 204C), and a photosensitive drum cleaner 209Y (209M, 209C) are provided around the photosensitive drum 201Y (201M, 201C). The primary charger 202Y (202M, 202C) is a charging roller.

Figure 3C:
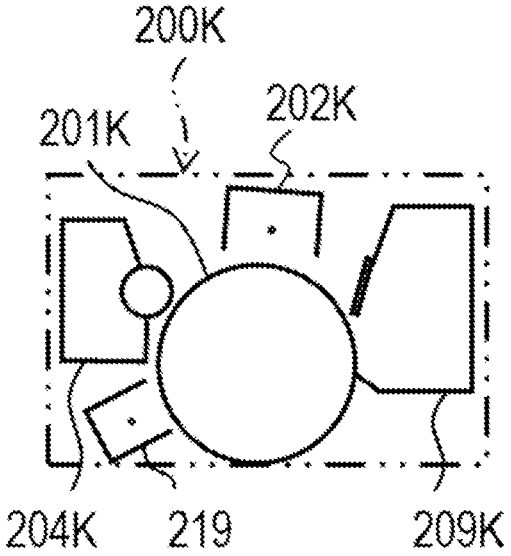
FIG. 3C is a view of a black image forming station.

FIG. 3C is a view of the black image forming station 200K. The black image forming station 200K forms a black (K) toner image. The black image forming station 200K includes a photosensitive drum 201K. A primary charger 202K, a developing device 204K, a pre-transfer charger 219, and a photosensitive drum cleaner 209K are provided around the photosensitive drum 201K. The primary charger 202K is a corona charger.

(Image Forming Process)

Image forming processes performed in the yellow image forming station 200Y, the magenta image forming station 200M, the cyan image forming station 200C, and the black image forming station 200K are substantially the same except for colors of the toners. Now, the image forming process performed in the yellow image forming station 200Y is described. As illustrated in FIG. 3B, a surface of the photosensitive drum 201Y of the yellow image forming station 200Y is uniformly charged by the primary charger 202Y. As illustrated in FIG. 3A, the laser scanner 203Y emits a laser beam to the photosensitive drum 201Y in accordance with image data to form an electrostatic latent image on the surface of the photosensitive drum 201Y. The developing device 204Y develops the electrostatic latent image with a yellow toner to form a yellow toner image on the surface of the photosensitive drum 201Y. When the toner in the developing device 204Y is used for the development, the yellow toner is suitably supplied from the toner bottle 205Y to the developing device 204Y through the toner supply path 206Y. A predetermined pressurizing force and an electrostatic load bias are applied by the primary transfer roller 207Y to the toner image on the surface of the photosensitive drum 201Y, and the toner image is transferred onto the intermediate transfer belt 208. After the transfer, a small amount of toner remaining on the photosensitive drum 201Y is removed by the photosensitive drum cleaner 209Y. The toner removed by the photosensitive drum cleaner 209Y is collected in the collected toner containers 211 through the toner collecting path 210.

Similarly, the magenta image forming station 200M, the cyan image forming station 200C, and the black image forming station 200K form a magenta toner image, a cyan toner image, and a black toner image, respectively. The magenta toner image, the cyan toner image, and the black toner image are transferred onto the intermediate transfer belt 208 in order. As a result, the toner images of the four colors are superimposed on the intermediate transfer belt 208.

Meanwhile, the sheets S are fed one by one from the sheet storage portions 212 of the image forming portion 102 or the high-capacity feeder 107, and are conveyed to the registration rollers 213. A leading edge of the sheet S is brought into abutment against a nip portion defined between the registration rollers 213 being in a stopped state to cause the sheet S to have a loop. In this manner, skew of the sheet S is corrected. After that, the registration rollers 213 start rotating and convey the sheet S to the secondary transfer portion ST so that a leading edge of the toner image on the intermediate transfer belt 208 and the leading edge of the sheet S are aligned with each other at the secondary transfer portion ST. A predetermined pressurizing force and an electrostatic load bias are applied, by the secondary transfer portion ST, to the toner image on the intermediate transfer belt 208, and the toner image is transferred onto the sheet S. After the transfer, a small amount of toner remaining on the intermediate transfer belt 208 is removed by the intermediate transfer belt cleaner 216. The toner removed by the intermediate transfer belt cleaner 216 is collected in the collected toner containers 211 through the toner collecting path 210. The sheet S carrying the toner image transferred thereto is conveyed to the fixing conveyance portion 103 by the pre-fixing conveyance belts 217.

(Fixing Conveyance Portion)

Figure 4:
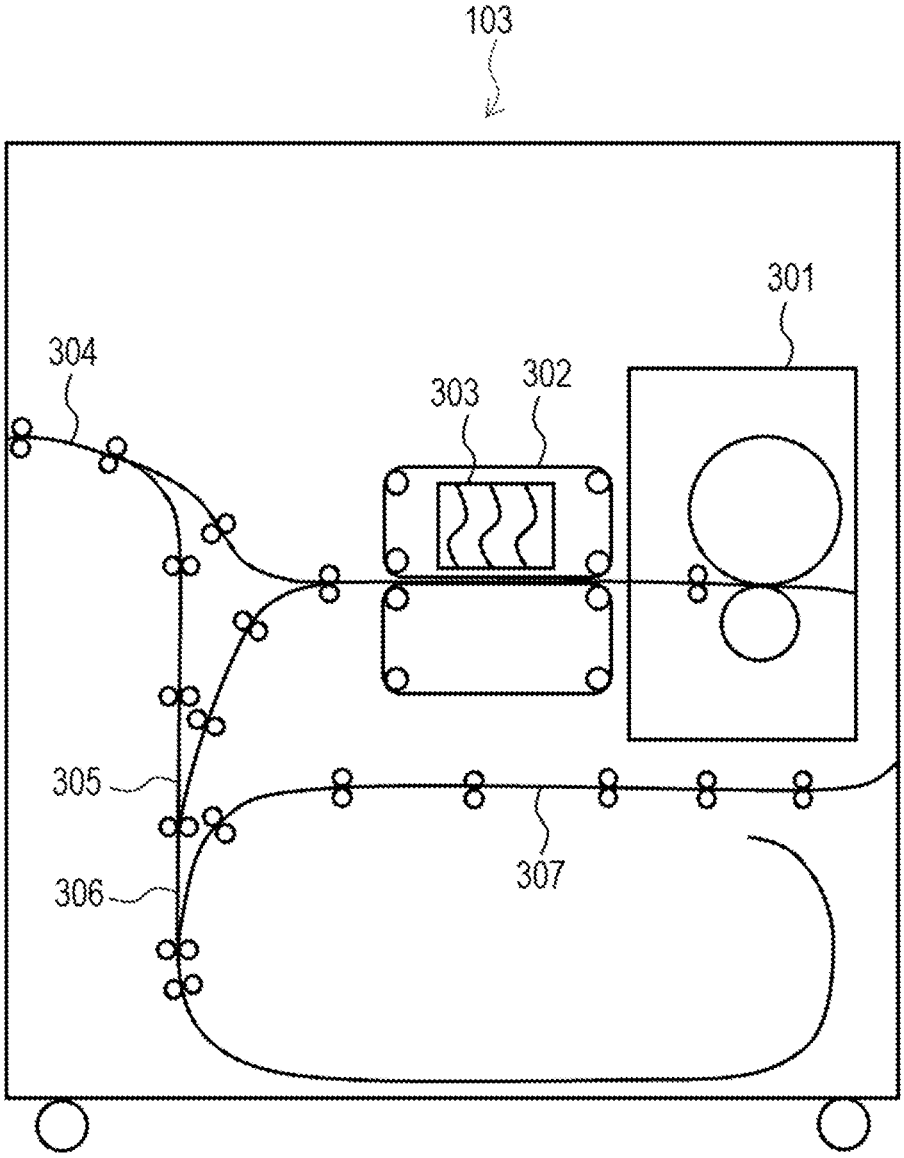
FIG. 4 is a sectional view of a fixing conveyance portion.

FIG. 4 is a sectional view of the fixing conveyance portion 103. The fixing conveyance portion 103 includes a fixing device 301, a cooler 302, a heat sink 303, a delivery conveyance path 304, a delivery reversing portion 305, a double-sided reversing portion 306, and a double-sided conveyance path 307. The fixing device 301 heats and pressurizes the toner image on the sheet S conveyed from the image forming portion 102 to fix the toner image onto the sheet S. The sheet S, which has been heated by the fixing device 301, is cooled through heat absorption by the heat sink 303 disposed in the cooler 302. The sheet S is delivered to the sensing device 108 via the delivery conveyance path 304. In a case in which the sheet S is delivered after being reversed, the sheet S is switched back at the delivery reversing portion 305 to switch a leading edge and a trailing edge of the sheet S. The sheet S, which has been reversed, is delivered via the delivery conveyance path 304.

Further, in a case in which images are formed on both sides of the sheet S, the sheet S carrying an image on a first side is switched back at the double-sided reversing portion 306 to switch a leading edge and a trailing edge of the sheet S. The sheet S, which has been reversed, is conveyed to the double-sided conveyance path 307. After that, the sheet S and subsequent sheets fed from the sheet storage portions 212 of the image forming portion 102 or the high-capacity feeder 107 are conveyed to the registration rollers 213 in order. Then, after an image is formed on a second side of the sheet S through the same image forming process as that for the first side, the sheet S is delivered via the delivery conveyance path 304.

(Monochrome Image Formation)

As described above, the image forming apparatus 101 according to the embodiment forms a full-color image by using the yellow image forming station 200Y, the magenta image forming station 200M, the cyan image forming station 200C, and the black image forming station 200K. The image forming apparatus 101 can also form a monochrome image by using only the black image forming station 200K. When a monochrome image is formed, the primary transfer rollers 207Y, 207M, and 207C, the auxiliary primary transfer roller 218, and the intermediate transfer belt 208 are moved by a separation mechanism (not shown) to positions indicated by broken lines in FIG. 3A. Rotational driving of the yellow image forming station 200Y, the magenta image forming station 200M, and the cyan image forming station 200C, which are separate from the intermediate transfer belt 208, is stopped. Specifically, undesirable wear of components, which may be caused along with unnecessary rotational driving, is prevented in the yellow image forming station 200Y, the magenta image forming station 200M, and the cyan image forming station 200C to thereby extend a life of each of the components.

The black photosensitive drum 201K has a diameter larger than those of the yellow photosensitive drum 201Y, the magenta photosensitive drum 201M, and the cyan photosensitive drum 201C, and thus has a life longer than those of the yellow photosensitive drum 201Y, the magenta photosensitive drum 201M, and the cyan photosensitive drum 201C. Further, the black primary charger 202K is a non-contact type corona charger, and has a life longer than those of the yellow primary charger 202Y, the magenta primary charger 202M, and the cyan primary charger 202C, which are contact type charger rollers. The black toner bottle 205K has a capacity larger than those of the yellow toner bottle 205Y, the magenta toner bottle 205M, and the cyan toner bottle 205C, and is suitable to achieve a longer life. When the monochrome image formation is frequently performed, maintenance on the black image forming station 200K, which is used at a higher frequency, is performed at shorter intervals. However, the above-mentioned configuration prevents the intervals of maintenance on the black image forming station 200K from becoming shorter than those for the yellow image forming station 200Y, the magenta image forming station 200M, and the cyan image forming station 200C, which are used at a lower frequency.

Further, the black image forming station 200K employs a large-diameter drum structure using the corona charger as the primary charger 202K. The black image forming station 200K has a charging width larger than those of small-diameter drum structures using the charging rollers as the primary chargers 202Y, 202M, and 202C, and thus has a structure suitable to achieve a higher speed. Hence, the black image forming station 200K enables the image forming portion 102 to achieve improved productivity in monochrome image formation.

The yellow image forming station 200Y, the magenta image forming station 200M, and the cyan image forming station 200C are different from the black image forming station 200K in shape, which may lead to different abrasion amounts of the components. Thus, a difference in toner charging amount may occur between each of the photosensitive drums 201Y, 201M, and 201C and the photosensitive drum 201K. When a difference occurs in toner charging amount, an unsatisfactory image may be formed because of ununiform transfer of the toner images onto the sheet S in a secondary transfer step. Thus, the black photosensitive drum 201K includes the pre-transfer charger 219, which is a corona charger, so as to achieve the same toner charging amount as those achieved by the yellow photosensitive drum 201Y, the magenta photosensitive drum 201M, and the cyan photosensitive drum 201C. As described above, with the configuration according to the embodiment, the image forming apparatus 101 with high productivity, high image quality, high stability, and a long life not only in full-color image formation but also in monochrome image formation is provided.

(Openable and Closable Doors)

Figure 5:
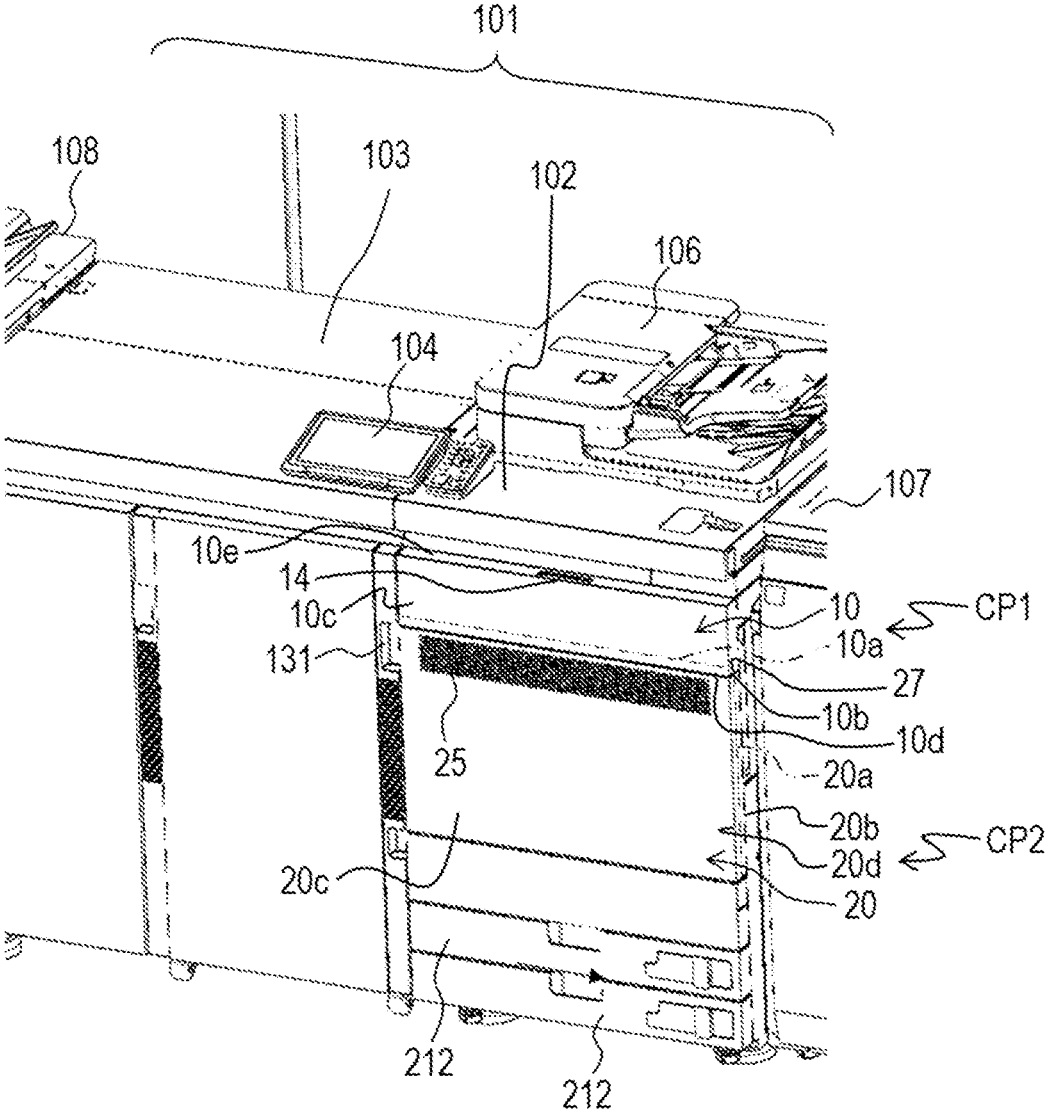
FIG. 5 is a perspective view for illustrating a toner bottle replacement door and a front surface door of the image forming portion.
Figure 6:
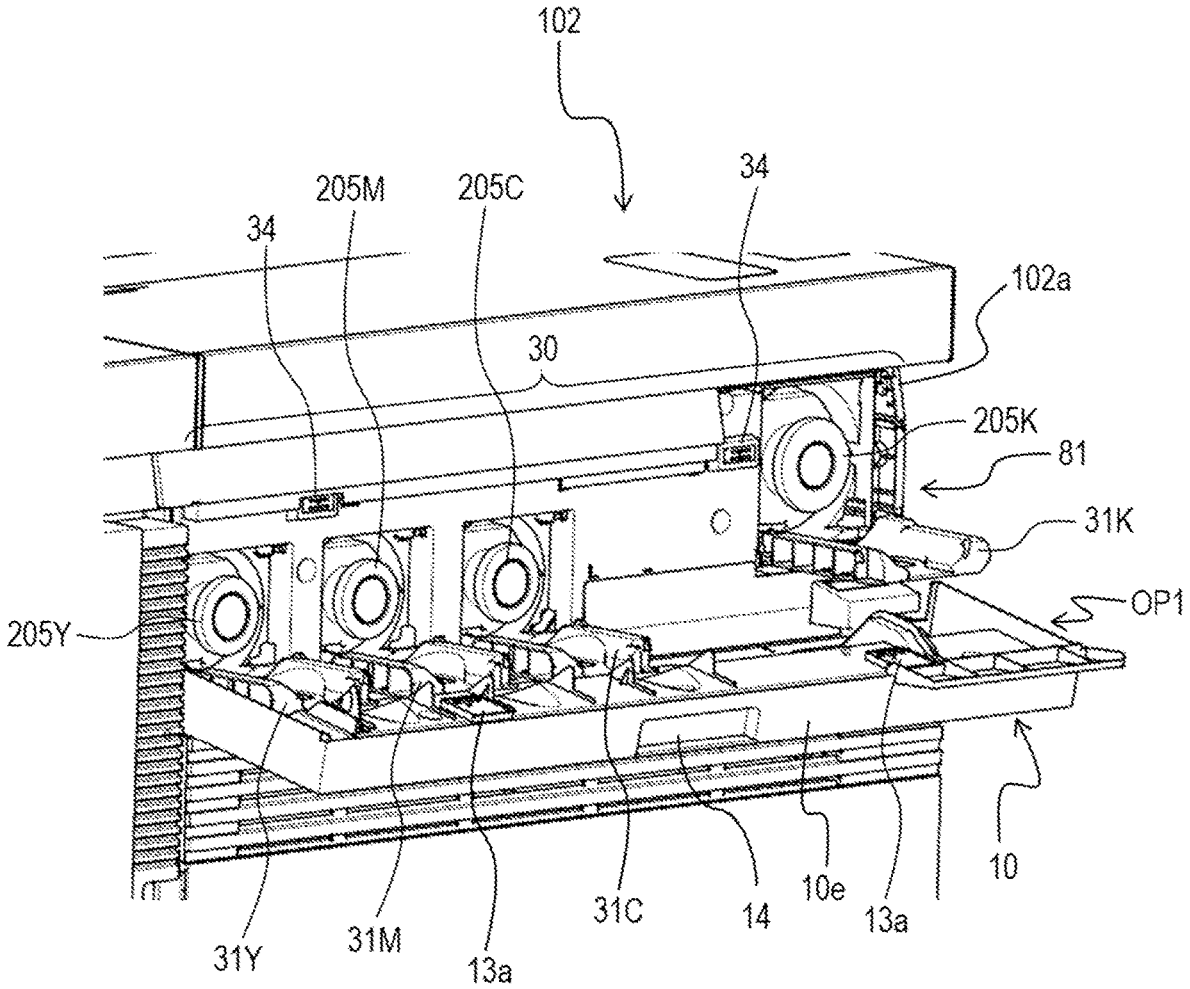
FIG. 6 is a perspective view of the image forming portion with the toner bottle replacement door and toner scattering prevention doors open.
Figure 7:
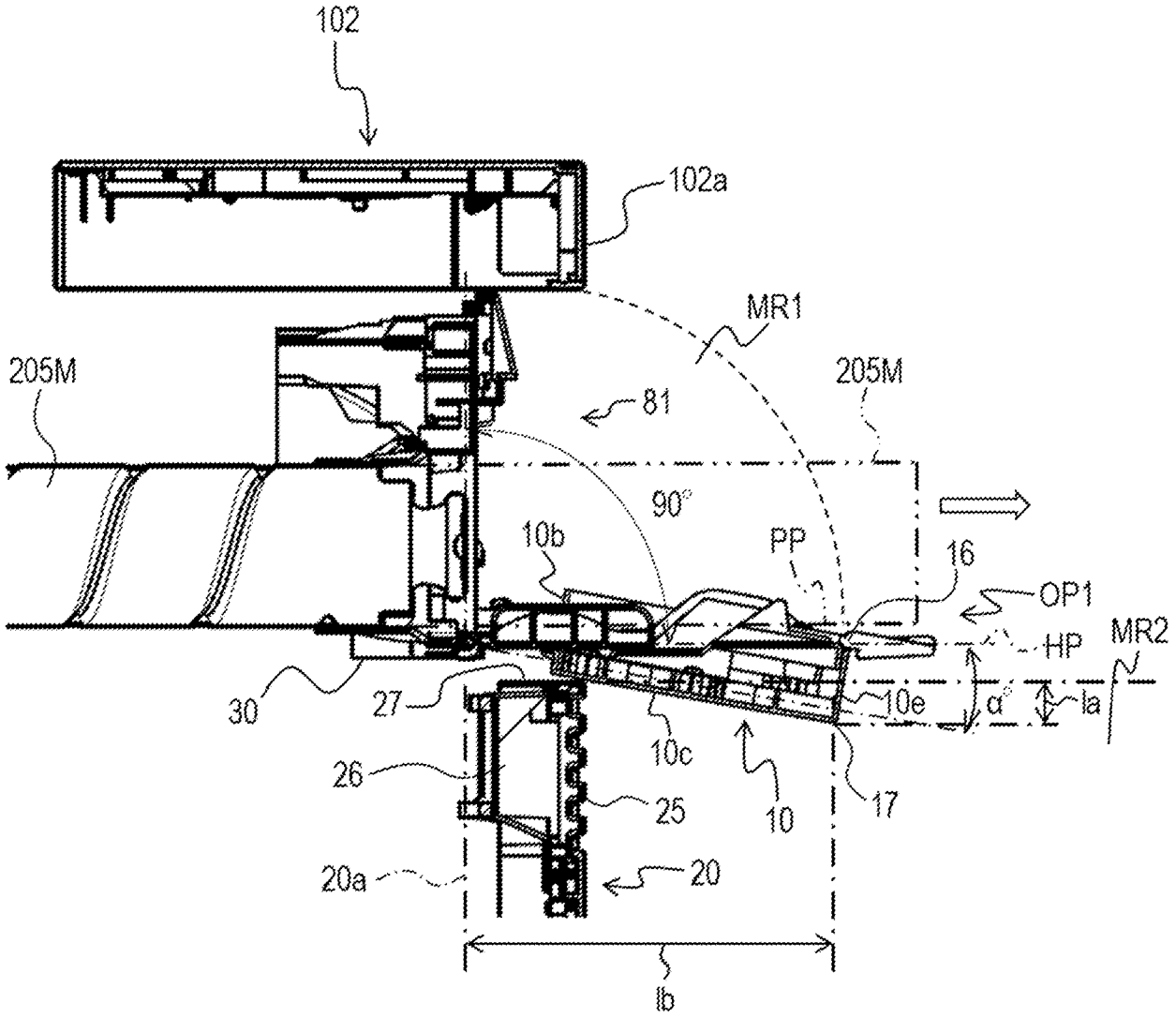
FIG. 7 is a sectional view of the image forming portion taken along the line VII-VII of FIG. 2.

Next, with reference to FIG. 1, FIG. 2, and FIG. 5 to FIG. 11C, configurations of the openable and closable doors (toner bottle replacement door 10 and front surface door 20) of the image forming portion 102 on its front side are described. FIG. 5 is a perspective view for illustrating the toner bottle replacement door (first openable and closable member) 10 and the front surface door (second openable and closable member) 20 of the image forming portion 102. FIG. 6 is a perspective view of the image forming portion 102 with the toner bottle replacement door 10 and toner scattering prevention doors 31 open for replacement of the toner bottles 205. FIG. 7 is a sectional view of the image forming portion 102 taken along the line VII-VII of FIG. 2.

Figure 8A:
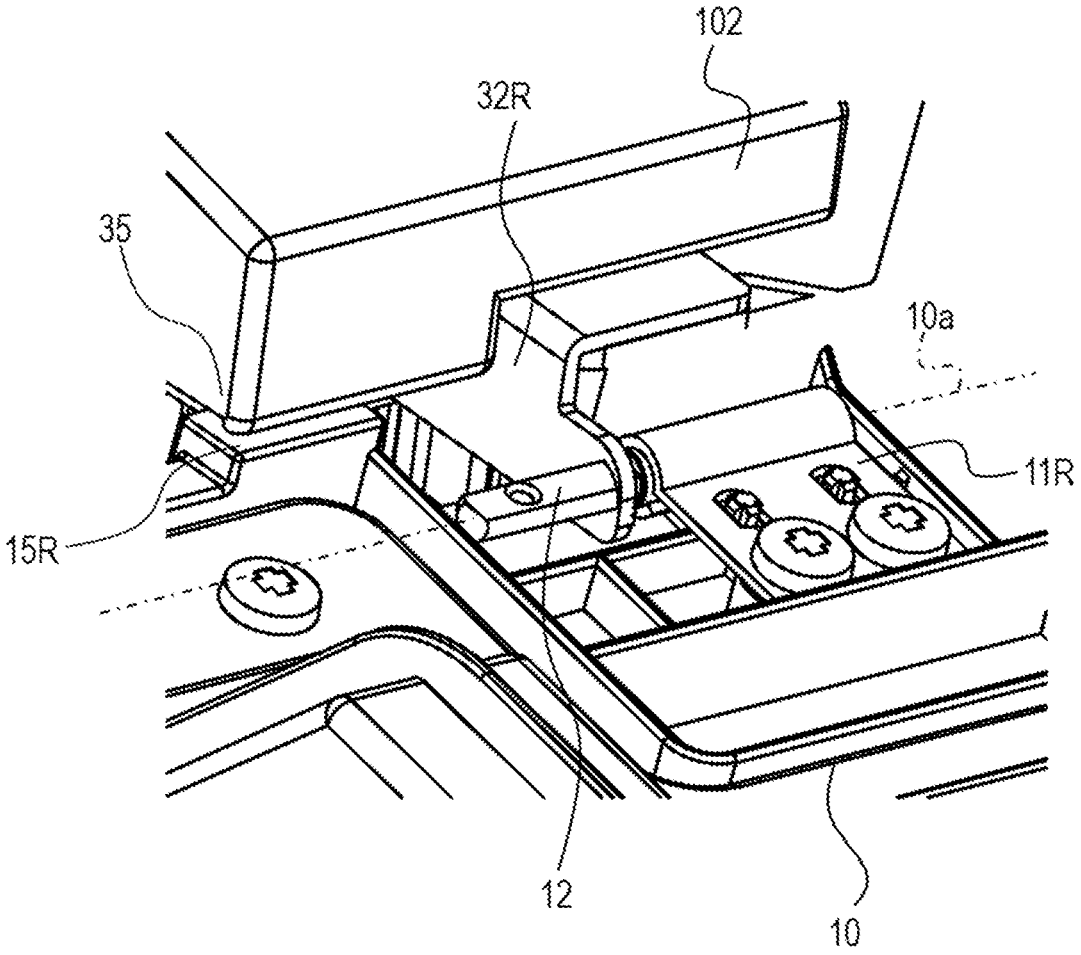
FIG. 8A and FIG. 8B are perspective views, each for illustrating a hinge member for the toner bottle replacement door.
Figure 8B:
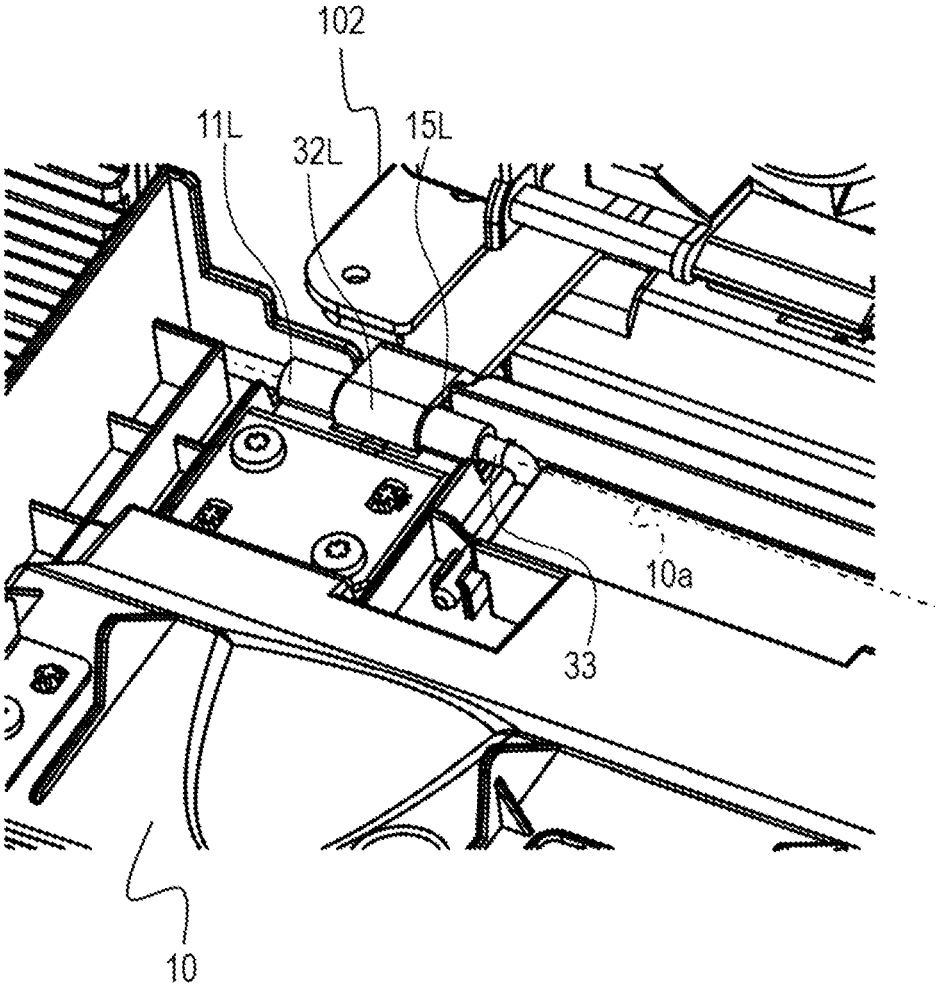
Figure 9A:
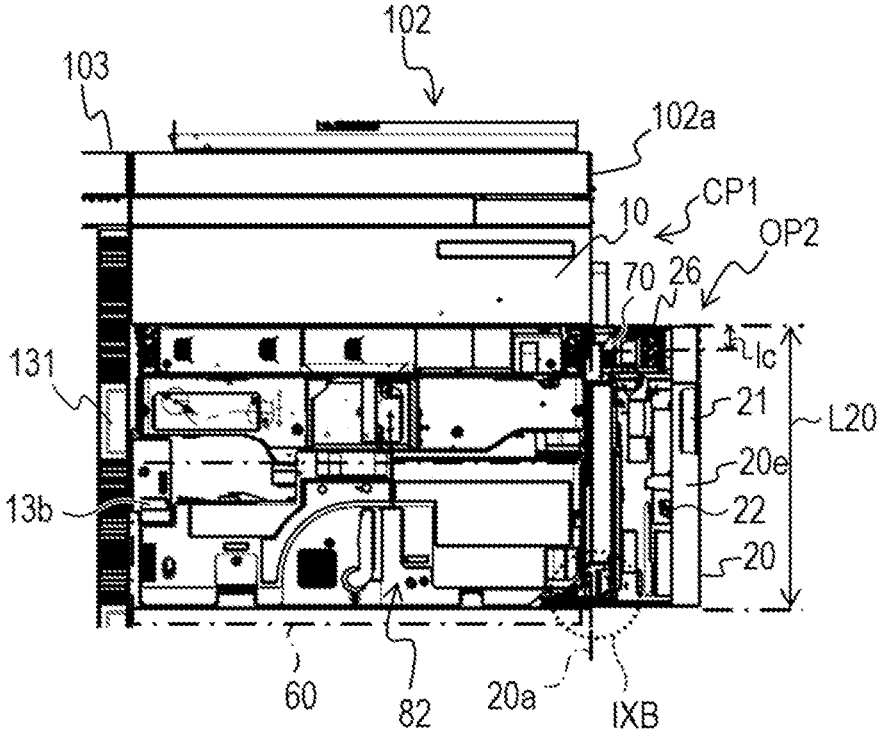
FIG. 9A, FIG. 9B, and FIG. 9C are views of the front surface door at an open position.
Figure 9B:
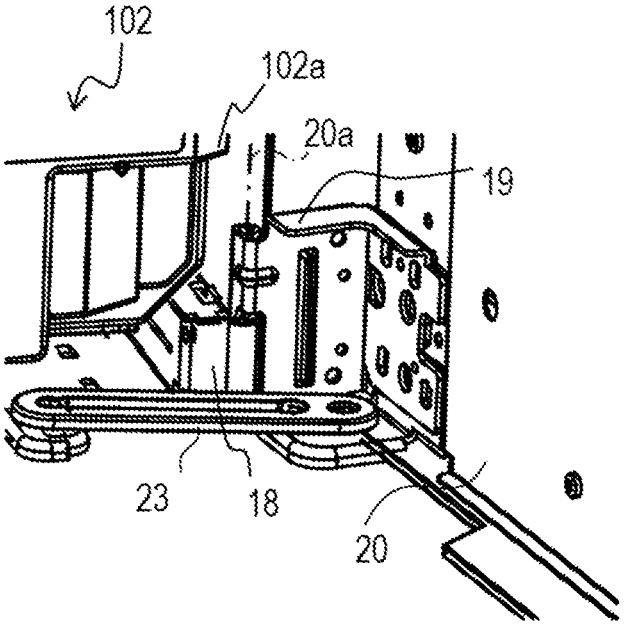
Figure 9C:
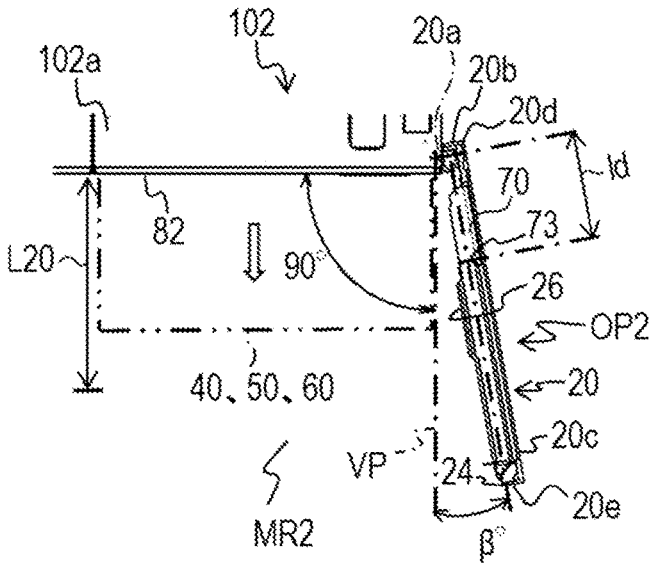
Figure 10:
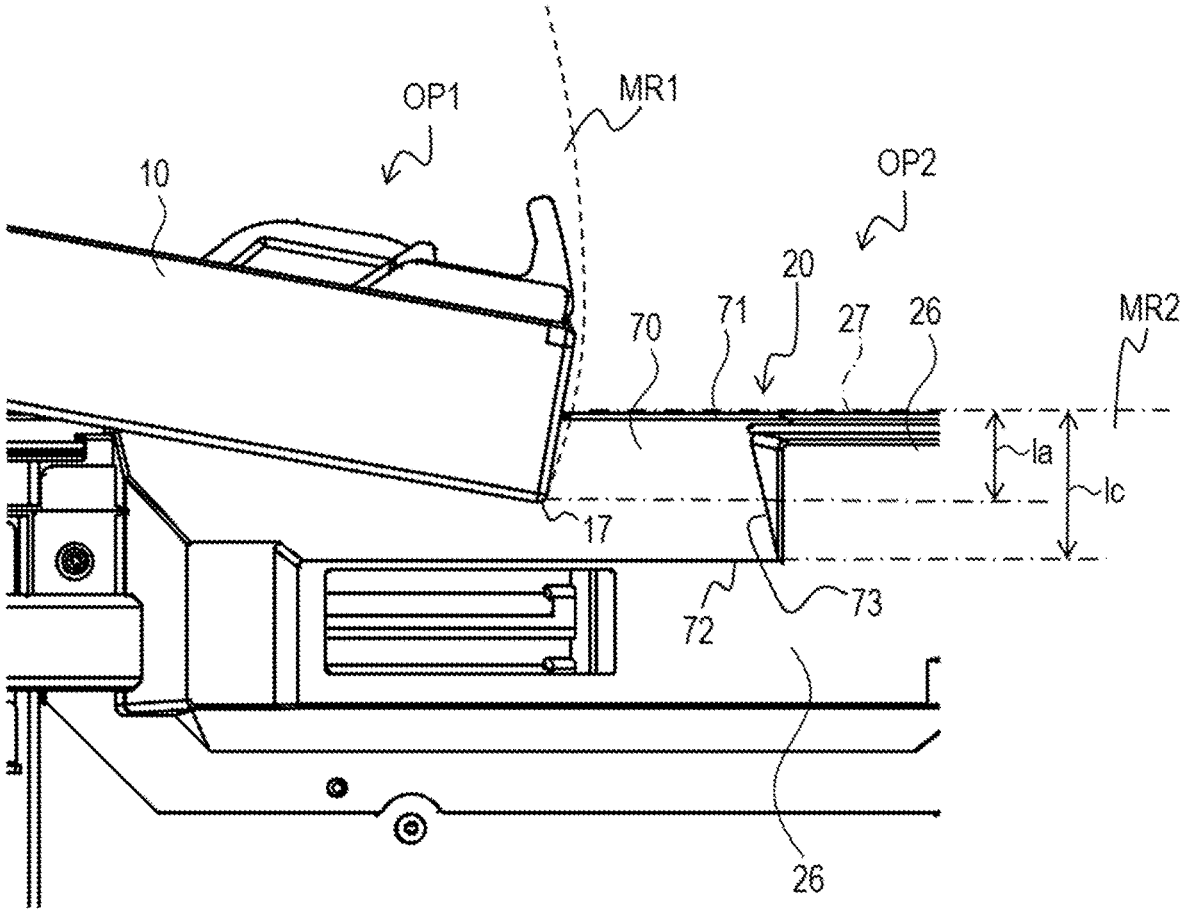
FIG. 10 is a view of the toner bottle replacement door and the front surface door at open positions.
Figure 11A:
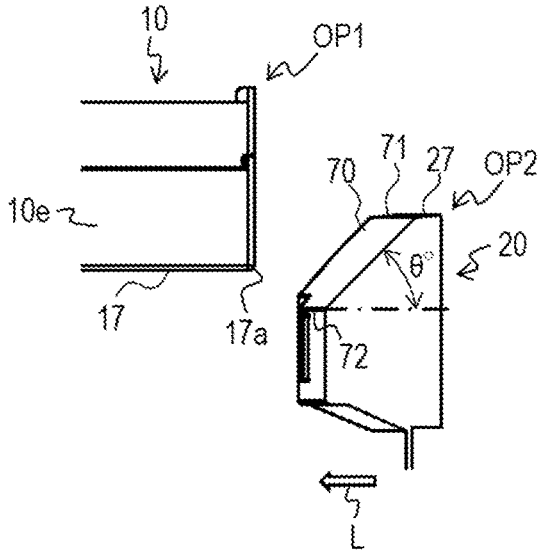
FIG. 11A, FIG. 11B, and FIG. 11C are explanatory views for illustrating a retracting operation of the toner bottle replacement door, which is performed in conjunction with a closing operation of the front surface door.
Figure 11B:
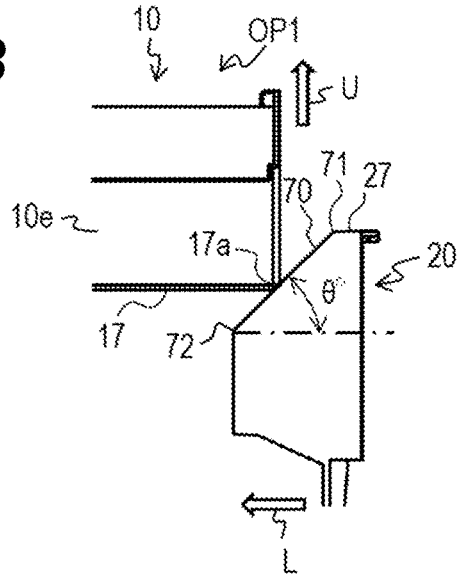
Figure 11C:
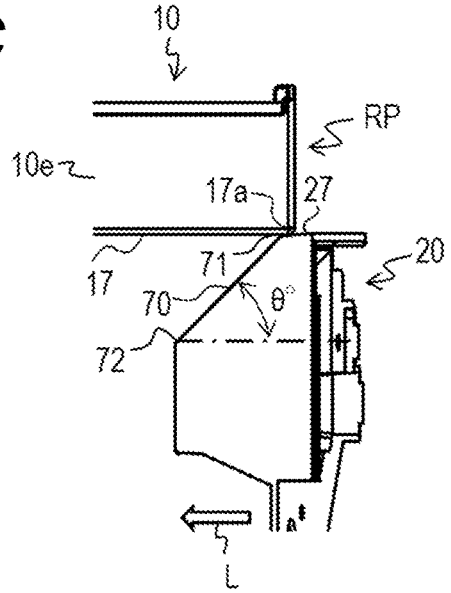

FIG. 8A is a perspective view of a door right hinge member 11R for the toner bottle replacement door 10. FIG. 8B is a perspective view of a door left hinge member 11L for the toner bottle replacement door 10. FIG. 9A, FIG. 9B, and FIG. 9C are views of the front surface door 20 at an open position. FIG. 10 is a view of the toner bottle replacement door 10 and the front surface door 20 at open positions. FIG. 11A, FIG. 11B, and FIG. 11C are explanatory views for illustrating a retracting operation of the toner bottle replacement door 10, which is performed in conjunction with a closing operation of the front surface door 20.

A main body 102*a* of the image forming portion 102 has a first opening portion 81 (FIG. 6) and a second opening portion 82 (FIG. 9A) on the front side. The first opening portion 81 and the second opening portion 82 are used for different purposes. The second opening portion 82 is formed immediately below the first opening portion 81. The toner bottle replacement door (first door) 10, which is an openable and closable door for opening and closing the first opening portion 81, is rotatably provided to the main body 102*a* of the image forming portion 102. The front surface door (second door) 20, which is an openable and closable door for opening and closing the second opening portion 82, is rotatably provided to the main body 102*a* of the image forming portion 102. The toner bottle replacement door 10 is arranged immediately above the front surface door 20 in a vertical direction.

As illustrated in FIG. 6, a toner containing portion 30 is provided inside the first opening portion 81. The toner bottles 205Y, 205M, 205C, and 205K for containing the toners are mounted into the toner containing portion 30. The toner containing portion 30 has toner scattering prevention doors 31Y, 31M, 31C, and 31K. The toner scattering prevention doors 31Y, 31M, 31C, and 31K are openably and closably provided to thereby prevent the toners from scattering into the image forming portion 102. The toner bottle replacement door 10 is movable within a first rotation range MR1 (FIG. 7) defined by a first open position OP1 for exposing the first opening portion 81 and a first closed position CP1 for covering the first opening portion 81 (FIG. 5). The toner bottle replacement door 10 is openably and closably provided to the main body 102*a* so as to open and close the toner containing portion 30. When the toner bottle replacement door 10 is located at the first closed position CP1, the toner bottle replacement door 10 covers the toner containing portion 30. After the toner bottle replacement door 10 is opened to expose the toner containing portion 30, the toner scattering prevention doors 31 are opened in accordance with an instruction input from the operation portion 104. Then, an operator can make access to the toner bottles 205. The operator can remove the old toner bottles 205 through the first opening portion 81 and removably mount new toner bottles 205 into the toner containing portion 30 through the first opening portion 81. This configuration enables the operator to perform replacement work for the toner bottles 205 without opening the front surface door 20.

FIG. 9A and FIG. 9C are a front view and a top view of the image forming portion 102 with the front surface door 20 open. FIG. 9B is an enlarged perspective view of a circled area IXB in FIG. 9A. The front surface door 20 is movable within a second rotation range MR2 defined by a second open position OP2 for exposing the second opening portion 82 and a second closed position CP2 for covering the second opening portion 82. In the embodiment, the front surface door 20 is opened rightward as illustrated in FIG. 9C. When the front surface door 20 is moved to the second open position OP2 to expose the second opening portion 82, an image forming unit 40, a transfer belt unit 50, or a sheet conveyance unit 60 in the main body 102*a* of the image forming portion 102 can be pulled out in a direction indicated by an arrow in FIG. 9C. As a result, the operator can perform maintenance such as periodic replacement for the image forming unit 40 or the transfer belt unit 50 and work, for example, to fix a jam of the sheet S in the sheet conveyance unit 60. A link mechanism (not shown) allows an opening and closing operation of the front surface door 20 in conjunction with an on/off operation of a power supply (not shown) of the image forming portion 102. A fail-safe is configured so that the power supply (not shown) is turned off when the front surface door 20 is opened. Meanwhile, an opening and closing operation of the toner bottle replacement door 10 is not associated with the on/off operation of the power supply (not shown). Thus, replacement work for the toner bottles 205 can be performed even while the image forming portion 102 is operating (while an image is being formed).

(Toner Bottle Replacement Door)

The toner bottle replacement door 10 is an openable and closable door having a horizontally elongated rectangular shape corresponding to a shape of the toner containing portion 30 located in an upper portion of the image forming portion 102. As illustrated in FIG. 5, when the toner bottle replacement door 10 is closed and is located at the first closed position CP1, a lower surface portion 10*b* of the toner bottle replacement door 10 is located in proximity to an upper surface portion 27 of the front surface door 20 located at the second closed position CP2. The toner bottle replacement door 10 is supported by the main body 102*a* of the image forming portion 102 so as to be rotatable about a rotation axis (first rotation axis) 10*a*. The rotation axis 10*a* extends in the vicinity of the lower surface portion 10*b* that extends horizontally and in the vicinity of a ridgeline 10*d* defined by a front surface portion 10*c* and the lower surface portion 10*b*, and is parallel to the ridgeline 10*d*. The rotation axis 10*a* is set to extend through a lower end portion of the toner bottle replacement door 10. Thus, an upper end portion of the toner bottle replacement door 10 is opened and closed.

As illustrated in FIG. 8A, a main body right hinge member 32R is provided to a right part of the image forming portion 102. The door right hinge member 11R is provided to a right part of the toner bottle replacement door 10. The door right hinge member 11R is coupled to the main body right hinge member 32R through intermediation of a hinge shaft 12, and is rotatable about the hinge shaft 12 with respect to the main body right hinge member 32R. As illustrated in FIG. 8B, a main body left hinge member 32L is provided to a left part of the image forming portion 102. The door left hinge member 11L is provided to a left part of the toner bottle replacement door 10. The door left hinge member 11L is coupled to the main body left hinge member 32L through intermediation of a hinge shaft 33, and is rotatable about the hinge shaft 33 with respect to the main body left hinge member 32L. The rotation axis 10*a* is defined by the hinge shaft 12 and the hinge shaft 33.

As illustrated in FIG. 6, magnets 34 are provided to the main body 102*a* of the image forming portion 102. Magnetic sheet metals 13*a* are provided onto the toner bottle replacement door 10. When the toner bottle replacement door 10 is closed and located at the first closed position CP1, the magnetic sheet metals 13*a* on the toner bottle replacement door 10 are attracted to the magnets 34 on the main body 102*a* by a magnetic force to thereby maintain the toner bottle replacement door 10 in the first closed position CP1. A handle portion 14, which is a recessed portion, is formed in an upper surface portion 10*e* of the toner bottle replacement door 10. The operator can insert his/her fingers in the handle portion 14. The operator inserts his/her fingers into the handle portion 14 to pull the handle portion 14 in the forward direction F against an attracting force of the magnets 34 to attract the magnetic sheet metals 13*a* to thereby rotate the toner bottle replacement door 10 about the rotation axis 10*a*. In this manner, the toner bottle replacement door 10 is moved to the first open position OP1. The operator can make access to the toner containing portion 30 through the first opening portion 81.

When the magnetic sheet metals 13*a* are released from the attracting force of the magnets 34, the toner bottle replacement door 10 tends to rotate downward about the rotation axis 10*a* under its own weight. However, the door right hinge member 11R is constructed of a torque hinge. Thus, when a torque equal to or larger than a predetermined rotational torque (rotational torque generated by the weight of the toner bottle replacement door 10 in the embodiment) is applied to the toner bottle replacement door 10, the toner bottle replacement door 10 rotates. Thus, an open angle of the toner bottle replacement door 10 is determined in accordance with the opening and closing operation of the toner bottle replacement door 10, which is performed by the operator. Hence, the toner bottle replacement door 10 is prevented from rotating downward under its own weight, and thus the generation of impact noise and damage of the toner bottle replacement door 10 are prevented.

As illustrated in FIG. 8A, the toner bottle replacement door 10 has a door right stopper portion 15R on its right side. The image forming portion 102 has a stopper receiving portion 35 on the right side. As illustrated in FIG. 8B, the toner bottle replacement door 10 has a door left stopper portion 15L on its left side. When the toner bottle replacement door 10 is caused to rotate to the first open position OP1, the door right stopper portion 15R of the toner bottle replacement door 10 is brought into abutment against the stopper receiving portion 35, and the door left stopper portion 15L is brought into abutment against the main body left hinge member 32L. As a result, the rotation of the toner bottle replacement door 10 is stopped at a predetermined open angle.

The predetermined open angle for the toner bottle replacement door 10 is described with reference to FIG. 7. When the toner bottle replacement door 10 is opened and located at the first open position OP1, the toner bottle 205M is horizontally pulled out from the toner containing portion 30 in a direction indicated by an arrow. Thus, a back-side edge portion 16 of the upper surface portion 10*e* of the toner bottle replacement door 10 is required to be located below a passage plane PP through which a lower surface of the toner bottle 205M passes when the toner bottle 205M is pulled out from and inserted into the toner containing portion 30. Thus, the toner bottle replacement door 10 is required to be opened wider in the downward direction D at a degrees from a horizontal plane HP in order that the back-side edge portion 16 of the upper surface portion 10*e* is located below the passage plane PP. The horizontal plane HP is located at 90 degrees in the downward direction D from the first opening portion 81. In the embodiment, the predetermined open angle of the toner bottle replacement door 10 at the first open position OP1 is set to 90 degrees+$\alpha$ degrees.

This configuration prevents the back-side edge portion 16, which projects upward when the toner bottle replacement door 10 is opened and is located at the first open position OP1, from interfering with the toner bottle 205M when inserted and pulled out. Closure ensuring ribs (not shown) for the toner scattering prevention doors 31 or a detection flag (not shown) for a sensor that detects an open state of the toner bottle replacement door 10 is provided on a back side of the toner bottle replacement door 10. A projecting structure such as the closure ensuring ribs (not shown) or the detection flag (not shown) is arranged so as not to interfere with the toner bottle 205M that is inserted and pulled out.

However, when the toner bottle replacement door 10 is located at the first open position OP1, an upper edge portion 17 of the front surface portion 10*c* of the toner bottle replacement door 10 makes inroads downward from the upper surface portion 27 of the front surface door 20 by a distance 1*a*. Further, the upper edge portion 17 of the front surface portion 10*c* protrudes in the forward direction F from a rotation axis (second rotation axis) 20*a* for the front surface door 20 by a distance 1*b*. Thus, when the front surface door 20 is opened or closed while the toner bottle replacement door 10 is located at the first open position OP1, the front surface door 20 interferes with the toner bottle replacement door 10.

In this case, in order to avoid the interference between the front surface door 20 and the toner bottle replacement door 10, it is conceivable to place the toner bottle replacement door 10 with the rotation axis of the toner bottle replacement door 10 aligned with the vertical direction so that the toner bottle replacement door 10 is openable and closable in the horizontal direction. In the embodiment, however, the plurality of toner bottles 205Y, 205M, 205C, and 205K are arranged side by side in the horizontal direction. Thus, the toner bottle replacement door 10 has a shape elongated in the horizontal direction. When the toner bottle replacement door 10, which is formed so that the toner bottle replacement door 10 is opened and closed in the horizontal direction with the rotation axis of the toner bottle replacement door 10 aligned with the vertical direction (horizontal swing structure), is opened, the toner bottle replacement door 10 projects significantly in the forward direction F. Thus, a large working space extending from the image forming apparatus 101 in the forward direction F is required to be secured. Meanwhile, in the embodiment, the toner bottle replacement door 10 is formed so as to rotate about the rotation axis 10*a* that is set to extend horizontally through a lower part of the toner bottle replacement door 10. Thus, when the toner bottle replacement door 10 is opened, the amount by which the toner bottle replacement door 10 projects in the forward direction F can be reduced.

(Front Surface Door)

The front surface door 20 is provided immediately below the toner bottle replacement door 10. Further, the front surface door 20 is formed so as to extend over a full width of the image forming portion 102. This configuration increases a size of the second opening portion 82 that is closed by the front surface door 20 so that the operator can easily make access to an inside of the image forming portion 102. As illustrated in FIG. 5, the front surface door 20 is supported by the main body 102*a* of the image forming portion 102 so as to be rotatable about the rotation axis 20*a*. The rotation axis 20*a* is located in the vicinity of a right side surface portion 20*b* that extends vertically and in the vicinity of a ridgeline 20*d* defined by a front surface portion 20*c* and the right side surface portion 20*b*, and is parallel to the ridgeline 20*d*. A main body hinge member 18 is provided to the main body 102*a*, and is coupled to a door hinge member 19 provided to the front surface door 20 through intermediation of a hinge shaft (not shown). The hinge shaft (not shown) that couples the main body hinge member 18 and the door hinge member 19 together defines the rotation axis 20*a*. The rotation axis 20*a* is set to extend through a right end portion of the front surface door 20. Thus, a left end portion of the front surface door 20 is opened and closed. The rotation axis 20*a* for the front surface door 20 extends in a direction that intersects with the rotation axis 10*a* for the toner bottle replacement door 10. In the embodiment, the rotation axis 20*a* extends in a direction orthogonal to the rotation axis 10*a*.

As illustrated in FIG. 9A, a magnetic sheet metal 13*b* is provided to the main body 102*a* of the image forming portion 102. A magnet 22 is provided to the front surface door 20. As illustrated in FIG. 5, when the front surface door 20 is closed and is located at the second closed position CP2, the magnet 22 on the front surface door 20 is attracted to the magnetic sheet metal 13*b* on the main body 102*a* by a magnetic force to thereby maintain the front surface door 20 in the second closed position CP2. As illustrated in FIG. 9A, a left side surface portion 20*e* of the front surface door 20 has a handle portion 21, which is a recessed portion. The operator can insert his/her fingers into the handle portion 21. A recessed portion 131 is formed at a boundary portion between the image forming portion 102 and the fixing conveyance portion 103 adjacent to the image forming portion 102 so as to allow the operator to easily insert his/her fingers into the handle portion 21. The operator inserts his/her fingers into the handle portion 21 to pull the handle portion 21 in the forward direction F against an attracting force of the magnet 22 to the magnetic sheet metal 13*b* to thereby rotate the front surface door 20 about the rotation axis 20*a*. In this manner, the front surface door 20 is moved to the second open position OP2. As illustrated in FIG. 9B, the front surface door 20 is opened at a predetermined open angle defined by a slider 23 that is provided to a lower right part of the front surface door 20 in the vicinity of the rotation axis 20*a*. The operator can make access to the inside of the image forming portion 102 through the second opening portion 82.

With reference to FIG. 9C, the predetermined open angle for the front surface door 20 is described. The front surface door 20 is opened so that projecting portions of components provided on a back side of the front surface door 20 are located on the right side of a rotation range of a unit that is inserted and pulled out in maintenance such as periodic replacement or work, for example, to fix a jam of the sheet S. In FIG. 9C, a rotation range of the image forming unit 40, the transfer belt unit 50, and the sheet conveyance unit 60 is indicated by an alternate long and two short dash line. The front surface door 20 is required to be opened wider in the rightward direction R at β degrees from a vertical plane VP so that the projecting portions on the back side of the front surface door 20 are located outside the rotation range. The vertical plane VP is a plane rotated at 90 degrees in the rightward direction R from the second opening portion 82. In the embodiment, the predetermined open angle of the front surface door 20 at the second open position OP2 is set to 90 degrees+β degrees.

This setting of the open angle prevents the projecting portions that project in the backward direction B with respect to the image forming portion 102 when the front surface door 20 is in a closed state, specifically, the front surface door 20 is located at the second closed position CP2 from interfering with each of the units that are removed and inserted when the front surface door 20 is located at the second open position OP2. The projecting portions provided on the back side of the front surface door 20 include, for example, a back-side edge portion 24 of the left side surface portion 20*e* of the front surface door 20 and an intake duct 26. The intake duct 26 allows an outside air, which is to be sucked into the main body 102*a* through an intake port 25 of the front surface portion 20*c* by a fan (not shown) provided to the main body 102*a*, to pass therethrough.

When the front surface door 20 is formed so as to be opened and closed in the upward and downward directions with the rotation axis of the front surface door 20 set to extend in the horizontal direction through a lower part of the front surface door 20 (vertical swing structure), the front surface door 20 projects in the forward direction F by a distance L20 illustrated in FIG. 9C when the front surface door 20 is opened. The front surface door 20 projecting in the forward direction F becomes an obstacle to work such as maintenance for the operator. However, when the front surface door 20 is formed so as to rotate about the rotation axis 20*a* and be opened and closed in the horizontal direction as described above, the rotation axis 20*a* is set in the vicinity of the ridgeline 20*d* defined by the front surface portion 20*c* and the right side surface portion 20*b* so as to extend in the vertical direction. This configuration secures a working space extending in the forward direction F from the second opening portion 82. When the front surface door 20 is opened at the predetermined open angle (90 degrees+β degrees) and is located at the second open position OP2, the front surface door 20 does not become an obstacle to work such as maintenance. For example, when the operator fixes a jam of the sheet S, the operator can pull out the sheet conveyance unit 60 by the amount necessary to fix the jam and efficiently fix the jam. According to the embodiment, high workability is achieved.

(Retracting Portion)

The above-mentioned normal door opening and closing operation only involves opening and closing of the openable and closable doors in accordance with work. However, some operators do not open and close the plurality of doors in the specified order. For example, the operator may erroneously open the plurality of doors for one kind of work. In the image forming apparatus 101 according to the embodiment, for example, the following state may be found.

In the embodiment, as illustrated in FIG. 5, the rotation axis 10*a* for the toner bottle replacement door 10 is substantially orthogonal to the rotation axis 20*a* for the front surface door 20. The operator can open the toner bottle replacement door 10 after opening the front surface door 20. FIG. 10 is an enlarged view of the front surface door 20 at the second open position OP2 and the toner bottle replacement door 10 at the first open position OP1 when viewed from the left side of the image forming portion 102. At the first open position OP1, the toner bottle replacement door 10 is open at the predetermined open angle (90+α) degrees from the first closed position CP1 as illustrated in FIG. 7. The upper edge portion 17 of the toner bottle replacement door 10 makes inroads downward from the upper surface portion 27 of the front surface door 20 into the second rotation range MR2 for the front surface door 20 by the distance 1*a*. As illustrated in FIG. 10, a part of the first rotation range MR1 for the toner bottle replacement door 10 makes inroads into the second rotation range MR2 for the front surface door 20.

The intake duct 26 is provided on an upper part of the front surface door 20. The front surface door 20 has an inclined surface 70 serving as a retracting portion. The inclined surface 70 is formed on an inner side of the upper part of the front surface door 20 so as to be located above the intake duct 26 and in the vicinity of part of the upper surface portion 27, through which the rotation axis 20*a* passes. As illustrated in FIG. 10, the inclined surface 70 has a length (height) 1*c* in a height direction (vertical direction) from an upper end portion 71 to a lower end portion 72. As illustrated in FIG. 9C, the inclined surface 70 has a length (width) 1*d* in the horizontal direction from the rotation axis 20*a* to an end portion 73 on a center side of the front surface door 20. As illustrated in FIG. 11A, the inclined surface 70 has an angle of θ degrees with respect to the horizontal plane.

The distance 1*a* in the second rotation range MR2 for the front surface door 20, over which the upper edge portion 17 of the toner bottle replacement door 10 moves, the distance 1*b* from the rotation axis 20*a* to the upper edge portion 17, the length 1*c* of the inclined surface 70 in the height direction, and the length 1*d* of the inclined surface 70 in the horizontal direction have the following relationship.

$$1a<1c \quad \text{(Expression 1)}$$

$$1b<1d \quad \text{(Expression 2)}$$

Further, in the embodiment, the angle θ of the inclined surface 70 is set to about 45 degrees.

With reference to FIG. 11A, FIG. 11B, and FIG. 11C, there is described a retracting operation of the toner bottle replacement door 10, which is performed in conjunction with the closing operation of the front surface door 20 when the toner bottle replacement door 10 is located at the first open position OP1 and the front surface door 20 is located at the second open position OP2. FIG. 11A, FIG. 11B, and FIG. 11C are enlarged views of the upper edge portion 17 of the toner bottle replacement door 10 and the inclined surface 70 of the front surface door 20 when viewed from the front side. FIG. 11A is a view for illustrating a state in which the toner bottle replacement door 10 is located at the first open position OP1 and the front surface door 20 is located at the second open position OP2 as illustrated in FIG. 10. The front surface door 20 is moved from the second open position OP2 in the leftward direction L toward the second closed position CP2.

According to the relationships expressed by Expression 1 and Expression 2, a right end portion (first abutment portion) 17*a* of the upper edge portion 17, which is located at a lowest position of the toner bottle replacement door 10, is first brought into contact with the inclined surface (second abutment portion) 70 as illustrated in FIG. 11B. When the inclined surface 70 is brought into abutment against the right end portion 17*a* of the upper edge portion 17 to further move the front surface door 20 in the leftward direction L, the inclined surface 70 pushes the toner bottle replacement door 10 in the upward direction U (FIG. 11B). The toner bottle replacement door 10 is pushed upward by the inclined surface 70, and is caused to rotate from the first open position OP1 toward the first closed position CP1 about the rotation axis 10*a* as a center of rotation.

When the front surface door 20 is further closed, the right end portion 17*a* of the upper edge portion 17 of the toner bottle replacement door 10 climbs up the inclined surface 70, and is pushed up to the upper end portion 71 of the inclined surface 70, as illustrated in FIG. 11C. As a result, the toner bottle replacement door 10 reaches a retracted position RP. When the toner bottle replacement door 10 is located at the retracted position RP, the toner bottle replacement door 10 allows movement of the front surface door 20 toward the second closed position CP2. The upper end portion 71 of the inclined surface 70 is set at substantially the same height position as the upper surface portion 27 of the front surface door 20. Thus, the front surface door 20 is closed toward the second closed position CP2 while the upper surface portion 27 of the front surface door 20 is maintaining the toner bottle replacement door 10 in the retracted position RP. After the front surface door 20 is closed to the second closed position CP2, the toner bottle replacement door 10 is closed to the first closed position CP1 to complete the work.

The toner bottle replacement door 10 according to the embodiment is a bottom-hinged door with the door right hinge member 11R and the door left hinge member 11L provided to the lower part. The front surface door 20 is a right-hinged door with the door hinge member 19 provided to the right part. The toner bottle replacement door 10 is arranged immediately above the front surface door 20. The first rotation range MR1 for the toner bottle replacement door 10 partially overlaps the second rotation range MR2 for the front surface door 20. When the toner bottle replacement door 10 is located at the first open position OP1, the upper edge portion 17 of the toner bottle replacement door 10 makes inroads into the second rotation range MR2 for the front surface door 20. According to the embodiment, however, when the front surface door 20 is closed, the inclined surface 70 serving as the retracting portion is brought into abutment against the toner bottle replacement door 10 to retract the toner bottle replacement door 10 to the retracted position RP. As a result, collision of the front surface door 20 against the toner bottle replacement door 10, which may damage the front surface door 20 or the toner bottle replacement door 10 or damage the main body right hinge member 32R, the main body left hinge member 32L, and the main body hinge member 18, each being an openable and closable door holding portion, is prevented. Thus, the supply of a consumable and maintenance work can be safely performed.

The image forming system 100 according to the embodiment includes the high-capacity feeder 107 and the sensing device 108 that are coupled to the image forming apparatus 101. However, the image forming system 100 is not limited to the above-mentioned configuration. The image forming apparatus 101 may be coupled to an apparatus having functions different from those of the apparatus in the embodiment. Further, the image forming apparatus 101 may be used alone.

The door hinge member 19 is provided to the right part of the front surface door 20 according to the embodiment, and allows the front surface door 20 to rotate about the rotation axis 20*a* extending in the vertical direction to open and close the left end portion of the front surface door 20. However, the configuration of the front surface door 20 is not limited to that described above. A door hinge member may be provided to a left part of the front surface door 20 to allow opening and closing of the right end portion of the front surface door 20.

In the embodiment, the handle portion 14 is formed in the upper surface portion 10*e* of the toner bottle replacement door 10. However, a position of the handle portion 14 of the toner bottle replacement door 10 is not limited to that described above. The handle portion 14 may be formed in a right side surface portion or a left side surface portion of the toner bottle replacement door 100, or each of the right side surface portion and the left side surface portion.

Further, in the embodiment, the angle θ of the inclined surface 70 is set to 45 degrees so that a force to close the front surface door 20 and a force to push up the toner bottle replacement door 10 become substantially equal to each other. However, the angle θ of the inclined surface 70 is not limited to the above-mentioned value. When the angle θ of the inclined surface 70 falls within a range of from 30 degrees to 60 degrees, the same effects are achieved.

Figure 12A:
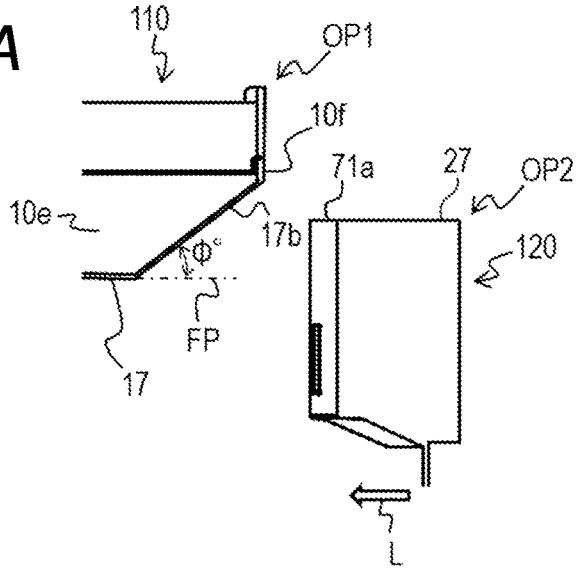
FIG. 12A, FIG. 12B, and FIG. 12C are explanatory views for illustrating a retracting operation of a toner bottle replacement door having an inclined surface.
Figure 12B:
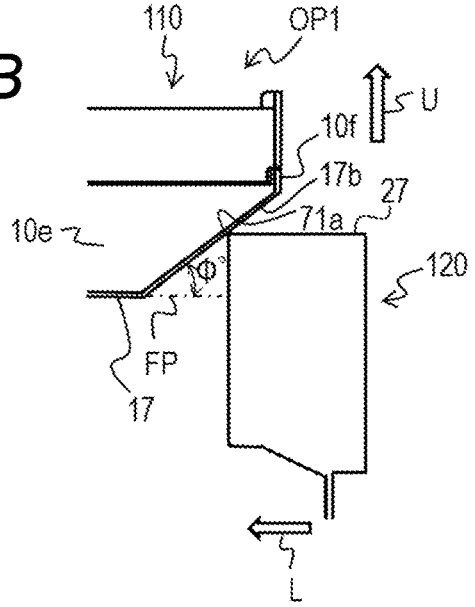
Figure 12C:
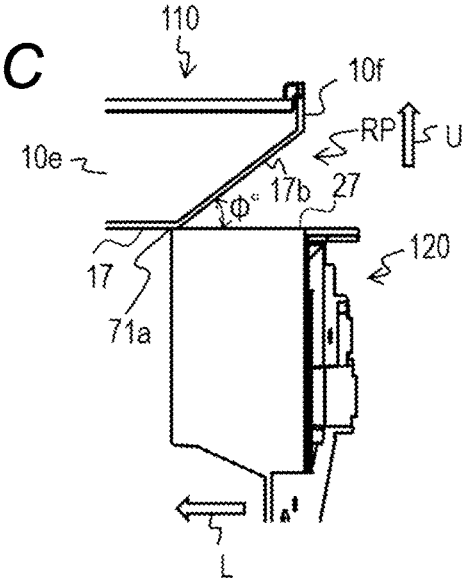

Further, in the embodiment, the front surface door 20 has the inclined surface 70 serving as the retracting portion. However, the position of the retracting portion is not limited to that described above. The toner bottle replacement door 10 may have a retracting portion. With reference to FIG. 12A, FIG. 12B, and FIG. 12C, a toner bottle replacement door 110 having a retracting portion is described. FIG. 12A, FIG. 12B, and FIG. 12C are explanatory views for illustrating a retracting operation of the toner bottle replacement door 110 having an inclined surface 17*b*, which is a retracting portion. The toner bottle replacement door 110 has the same structure as that of the toner bottle replacement door 10 described above except for the presence of the inclined surface 17*b*. Further, a front surface door 120 has the same structure as that of the front surface door 20 described above except for the absence of the inclined surface 70. The same structures are denoted by the same reference symbols, and the description thereof is omitted. The toner bottle replacement door 110 has the inclined surface 17*b* between a right side surface portion 10*f* and the front surface portion 10*c*. The inclined surface 17*b* has an angle of ϕ degrees with respect to a plane FP that is parallel to the front surface portion 10*c* when viewed in a direction toward the upper surface portion 10*e* of the toner bottle replacement door 110.

FIG. 12A is a view for illustrating a state in which the toner bottle replacement door 110 is located at the first open position OP1 and the front surface door 120 is located at the second open position OP2. The front surface door 120 is moved in the leftward direction L from the second open position OP2 toward the second closed position CP2. An upper end portion (second abutment portion) 71*a* of the front surface door 120 on its inner side is first brought into contact with the inclined surface (first abutment portion) 17*b* of the toner bottle replacement door 110, as illustrated in FIG. 12B. When the upper end portion 71*a* is brought into abutment against the inclined surface 17*b* to further move the front surface door 120 in the leftward direction L, the upper end portion 71*a* pushes the toner bottle replacement door 110 in the upward direction U (FIG. 12B). The toner bottle replacement door 110 is pushed upward by the upper end portion 71*a*, and is caused to rotate about the rotation axis 10*a* as a center of rotation from the first open position OP1 toward the first closed position CP1.

When the front surface door 120 is further closed, the inclined surface 17*b* of the toner bottle replacement door 110 is pushed upward by the upper end portion 71*a* of the front surface door 120, as illustrated in FIG. 12C. Then, the toner bottle replacement door 110 reaches a retracted position RP. When the toner bottle replacement door 110 is located at the retracted position RP, the toner bottle replacement door 110 allows the front surface door 120 to move toward the second closed position CP2. The upper edge portion 17 of the toner bottle replacement door 110 reaches and moves onto the upper surface portion 27 of the front surface door 120. The front surface door 120 is closed toward the second closed position CP2 while the toner bottle replacement door 110 is maintained in the retracted position RP. After the front surface door 120 is closed to the second closed position CP2, the toner bottle replacement door 110 is closed to the first closed position CP1 to complete the work.

According to the embodiment, the first door is moved to the retracted position in conjunction with the closing operation of the second door. In this manner, damage of the first door and the second door can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-077682, filed Apr. 30, 2021, which is hereby incorporated by reference herein in its entirety.

What is claimed is:

1. An image forming apparatus configured to form an image on a recording medium, the image forming apparatus comprising:

a main body provided with a first inside portion and a second inside portion;

a first door rotatable within a first rotation range between a first open position at which the first door exposes the first inside portion and a first closed position at which the first door covers the first inside portion, the first door being rotatable within the first rotation range about a first rotation axis extending in a width direction of the image forming apparatus;

a second door provided below the first door in a vertical direction and rotatable within a second rotation range between a second open position at which the second door exposes the second inside portion and a second closed position at which the second door covers the second inside portion, a part of the first rotation range making inroads into the second rotation range, the second door being rotatable within the second rotation range about a second rotation axis extending in a direction orthogonal to the first rotation axis; and a retracting portion configured to cause the first door to rotate to a retracted position, at which the first door allows a rotation of the second door, in conjunction with the second door being rotated to the second closed position from a state in which the first door is located at the first open position and the second door is located at the second open position, wherein the retracting portion includes a first abutment portion provided on the first door and a second abutment portion provided on the second door, and when the second door is moved from the second open position toward the second closed position, the second abutment portion is brought into abutment against the first abutment portion to move the first door to the retracted position.

2. The image forming apparatus according to claim 1, wherein the second rotation axis is provided on a right side of the second door in the width direction of the image forming apparatus in a state in which the second door is located at the second closed position.

3. The image forming apparatus according to claim 1, wherein the second rotation axis is provided on a left side of the second door in the width direction of the image forming apparatus in a state in which the second door is located at the second closed position.

4. The image forming apparatus according to claim 1, wherein the first abutment portion is an outer side corner on an upper edge of the first door, and wherein the second abutment portion is an inclined surface provided on an inner side of an upper edge of the second door.

5. The image forming apparatus according to claim 1, wherein the first abutment portion is an inclined surface provided between a front surface portion and a top surface portion of the first door, and wherein the second abutment portion is an inner side corner on an upper edge of the second door.

6. The image forming apparatus according to claim 1, wherein the first inside portion includes a toner container configured to contain toner, the toner container being removably mounted to the main body so that the toner container is removed from the main body in a case in which the first door is located at the first open position.

7. The image forming apparatus according to claim 1, further comprising:

an image forming portion configured to form a toner image on the recording medium; and a fixing conveyance portion configured to fix the toner image formed by the image forming portion onto the recording medium.

8. The image forming apparatus according to claim 7, wherein the main body is provided to the image forming portion, and wherein the image forming portion and the fixing conveyance portion are constructed of independent housings, respectively.

9. An image forming system comprising:

an image forming apparatus including:

a main body provided with a first inside portion and a second inside portion;

a first door rotatable within a first rotation range between a first open position at which the first door exposes the first inside portion and a first closed position at which the first door covers the first inside portion, the first door being rotatable within the first rotation range about a first rotation axis extending in a width direction of the image forming apparatus;

a second door provided below the first door in a vertical direction and rotatable within a second rotation range between a second open position at which the second door exposes the second inside portion and a second closed position at which the second door covers the second inside portion, a part of the first rotation range making inroads into the second rotation range, the second door being rotatable within the second rotation range about a second rotation axis extending in a direction orthogonal to the first rotation axis; and a retracting portion configured to cause the first door to rotate to a retracted position, at which the first door allows a rotation of the second door, in conjunction with the second door being rotated to the second closed position from a state in which the first door is located at the first open position and the second door is located at the second open position;

an operation portion configured to operate the image forming apparatus; and a feeder configured to feed the recording medium to the image forming apparatus, wherein the retracting portion includes a first abutment portion provided on the first door and a second abutment portion provided on the second door, and when the second door is moved from the second open position toward the second closed position, the second abutment portion is brought into abutment against the first abutment portion to move the first door to the retracted position.

10. The image forming system according to claim 9, wherein the first abutment portion is an outer side corner on an upper edge of the first door, and wherein the second abutment portion is an inclined surface provided on an inner side of an upper edge of the second door.

11. The image forming system according to claim 9, wherein the first abutment portion is an inclined surface provided between a front surface portion and a top surface portion of the first door, and wherein the second abutment portion is an inner side corner on an upper edge of the second door.

12. The image forming system according to claim 9, wherein the first inside portion includes a toner container configured to contain toner, the toner container being removably mounted to the main body so that the toner container is removed from the main body in a case in which the first door is located at the first open position.

* * * * *